US006257512B1

(12) United States Patent
Schoeck et al.

(10) Patent No.: US 6,257,512 B1
(45) Date of Patent: Jul. 10, 2001

(54) MAGNETIZED PRE-WOUND SIDELESS BOBBINS

(75) Inventors: Vincent E. Schoeck; Edwin E. Fuller, both of Hagerstown, MD (US)

(73) Assignee: Fil-Tec, Inc., Cavetown, MD (US)

( * ) Notice: Subject to any disclaimer, the term of this patent is extended or adjusted under 35 U.S.C. 154(b) by 0 days.

(21) Appl. No.: 09/447,740

(22) Filed: Nov. 23, 1999

Related U.S. Application Data

(60) Provisional application No. 60/112,623, filed on Dec. 16, 1998.

(51) Int. Cl.[7] ..... B65H 18/28

(52) U.S. Cl. ..... 242/170; 242/118.3; 242/118.32; 242/422.2; 242/423.2; 242/610.4; 242/610.6

(58) Field of Search ..... 242/422.2, 423.1, 242/423.2, 610.4, 610.6, 147.4, 118.32, 118.7, 170, 610.5, 613.5, 118.3

(56) References Cited

U.S. PATENT DOCUMENTS

| | | | | |
|---|---|---|---|---|
| 2,543,475 | | 2/1951 | Slodysko . | |
| 2,763,227 | | 9/1956 | Howard . | |
| 2,975,738 | | 3/1961 | Hoppe . | |
| 3,599,892 | | 8/1971 | Brouwer et al. . | |
| 3,695,531 | | 10/1972 | Whitehead . | |
| 3,716,202 | | 2/1973 | Thomas . | |
| 3,731,479 | | 5/1973 | Flowers et al. . | |
| 3,940,089 | | 2/1976 | Lindquist . | |
| 4,100,866 | * | 7/1978 | Philips | 242/118.3 X |
| 4,187,792 | * | 2/1980 | Boser et al. | 112/286 |
| 4,331,090 | | 5/1982 | Hanyu et al. . | |
| 4,429,649 | | 2/1984 | Eguchi et al. . | |
| 4,458,854 | | 7/1984 | Richard . | |
| 4,530,296 | * | 7/1985 | Takenoya et al. | 112/229 |
| 5,018,465 | * | 5/1991 | Hager et al. | 112/273 |
| 5,152,236 | * | 10/1992 | Hirose | 112/231 |
| 5,188,046 | * | 2/1993 | Badillo | 112/231 |
| 5,709,347 | | 1/1998 | Hoffmann et al. . | |
| 5,875,983 | * | 3/1999 | Stuckey et al. | 242/118.32 |

FOREIGN PATENT DOCUMENTS

| | | | |
|---|---|---|---|
| 5-68764 | * | 3/1993 | (JP) . |
| 10-80592 | * | 3/1998 | (JP) . |

OTHER PUBLICATIONS

JP10–80592 Abstract.*

* cited by examiner

*Primary Examiner*—Christopher P. Ellis
*Assistant Examiner*—Minh-Chau Pham
(74) *Attorney, Agent, or Firm*—Nixon & Vanderhye P.C.

(57) ABSTRACT

Magnetized bobbin cores are preferably wound with sewing thread to obtain sideless, pre-wound bobbins that have beneficial draw-off tensions, draw-off tension uniformity and overspin characteristics. The pre-wound sideless bobbins may thus be satisfactorily used in lock stitch sewing applications due to improved uniformity of draw-off tension combined with reduced bobbin overspin. The magnetized pre-wound sideless bobbins are also especially well suited for end-use sewing applications where automatic bobbin changing equipment is employed. Most preferably, the core is a cylinder formed of a thermoplastic or thermoset material in which magnetized particles are dispersed.

39 Claims, 1 Drawing Sheet

MAGNETIZED PRE-WOUND SIDELESS BOBBINS

CROSS-REFERENCE TO PRIOR APPLICATION

Figure 1:
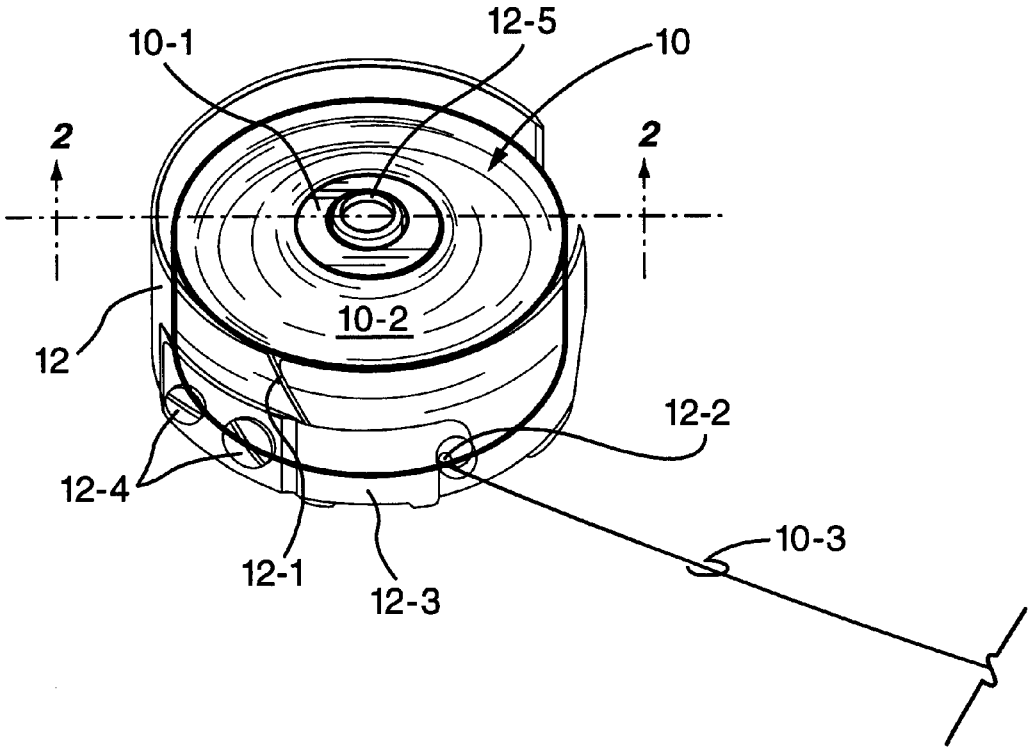

This application is based on, and claims domestic priority benefits under 35 USC §119(e) from, U.S. Provisional Patent Application Ser. No. 60/112,623 filed on Dec. 16, 1998, the entire content of which is expressly incorporated hereinto by reference.

FIELD OF THE INVENTION

The present invention relates generally to magnetized bobbins which are pre-wound with sewing thread. More specifically, the present invention relates to pre-wound sideless bobbins which may be satisfactorily used in lock stitch sewing applications due to improved uniformity of draw-off tension combined with reduced bobbin overspin. The magnetized pre-wound sideless bobbins of this invention are also especially well suited for end-use sewing applications where automatic bobbin changing equipment is employed.

BACKGROUND OF THE INVENTION

During lock stitch sewing, stitches are formed by a needle thread or threads, introduced from one side, interlacing with an underthread supplied from a bobbin on the other side. Typical lock stitch sewing results in strong seams with good strength and abrasion resistance, but has a disadvantage in the limited length of sewing that is possible before having to replace the underthread bobbin.

In this regard, the underthread is supplied or delivered from a bobbin which is located in a bobbin case. When performing lock stitch sewing, a commercial sewer will typically purchase pre-wound bobbins that are already wound with sewing thread in such a fashion that they can be placed inside the bobbin case for sewing. Pre-wound bobbins are conventionally supplied either with sidewalls (known in the art as "pre-wound sidewall bobbins") or without sides (known in the art as "pre-wound sideless bobbins").

Sidewall bobbins have a flange made typically from cardboard, plastic or paper. The thread is typically wound onto a flangeless core with the sidewalls (flanges) thereafter being attached to the core ends in a secondary operation. Alternatively, the thread may be wound onto a core with the sidewalls already attached. The former bobbin-winding technique allows the finished bobbin to be sized correctly by virtue of the pressure applied during the sidewall attachment process.

The reasons for having sidewalls on a bobbin include (i) preventing the yarn from looping under the bobbin Qr over the bobbin case post and subsequently breaking, (ii) controlling the thread draw-off tension, and (iii) acting as a braking mechanism to reduce thread overspinning or backlash when sewing stops. In addition to these functions, bobbin sidewalls typically have been thought to be required for proper performance on recently developed automated bobbin changing equipment.

Sideless bobbins have no sidewalls. In this regard, yarn is conventionally wound onto a cylindrical core in the production of pre-wound sideless bobbins. Unlike sidewall bobbins, the yarn wound on a sideless bobbin is tacked together to control the amount and uniformity of draw-off tension, prevent the yarn from looping under or over the bobbin and subsequently breaking, and control or reduce bobbin backlash or overspinning when sewing stops. A variety of techniques may be employed to tack the yarn on the sideless bobbins. For example, tacking the yarn together on the bobbin can be done by softening a bond that is on the yarn via heat or chemical reaction or simply applying a tacking agent, such as wax or other soft, tacky materials, to the yarn.

Underthread supplied from a bobbin has a significant impact on seam quality as well as sewing productivity. The correct amount and uniformity of bobbin draw-off tension throughout the entire bobbin is important to achieve seam quality and performance.

The amount of draw-off tension is largely controlled by loosening or tightening a leaf spring located on the bobbin case so as to responsively decrease or increase, respectively, the spring's contact force against the thread. Draw-off tension which is not set correctly at the leaf spring or which changes during the sewing operation will cause loose stitches (on top or bottom) thus creating a defective seam. It is recognized in this art that the leaf spring is most desirably set so as to cause the thread to exhibit the least amount of draw-off tension consistent with high quality stitches. Lesser leaf spring pressure force on the thread, and thus a lesser amount of resulting draw-off tension, is known to cause less thread degradation due to frictional abrasion by the spring (and thereby also lessen the potential for thread lint and other debris to build-up under the spring). In addition, a lesser amount of spring pressure will not exacerbate tension non-uniformity caused inherently by thread surface irregularities.

The uniformity of draw-off tension as the bobbin is unwinding can be controlled or influenced by many factors. These factors include bobbin sidewalls, uniformity of yarn or thread diameter and thread friction, amount and uniformity of tack as the bobbin unwinds, and the ability of the tension spring to maintain uniform pressure or tension on the yarn as it passes through the bobbin case tension spring. It is generally known in the art that a lower variation in bobbin draw-off tension will produce, over time, a more consistent sewn seam or stitch.

In addition to the amount and uniformity of the draw-off tension, controlling bobbin backlash or overspinning when sewing stops is another critical bobbin characteristic. Specifically, when the thread ceases to be pulled from the bobbin case, the bobbin in the bobbin case must not continue to spin and unravel to the point that the thread loops under the bobbin or over the bobbin case post which can snag and break when sewing is resumed. Even if the bobbin thread does not loop over or under the bobbin and snag after it overspins, the resulting slack created in the bobbin case can cause seam quality defects due to the subsequent tension variation once sewing is resumed.

Primary methods of controlling bobbin backlash or overspinning include the flanges on sidewall bobbins as well as the amount of tack on sideless bobbins. For example, the flanges of a sidewall bobbin act as a braking mechanism to help reduce the amount of backlash or overspinning when sewing stops. In addition, the flanges of a sidewall bobbin prevent the thread from looping over or under the bobbin. The amount of tack on a sideless bobbin will help reduce the amount of backlash or overspinning when sewing stops. Generally, the higher the bobbin tack level, the less overspinning or backlash. Assuming the proper amount and uniformity of draw-off tension, it is generally known in the art that the least amount of bobbin overspin will produce a more consistent sewn seam due to less tension variations and reduce the possibility of bobbin thread breaks.

While lockstitch sewing can create a very strong seam with low bulk that will not unravel, the disadvantage of lockstitch sewing is that you are limited to relatively short production runs before the underthread in the bobbin case runs out and needs to be replaced. Thus, the more yards that are provided on a given type and size of pre-wound bobbin, the fewer bobbin changes will be required which results in higher productivity—i.e., the sewing machine spends less unproductive down time to replace the bobbin and more production time is spent actually sewing. For example, assuming similar thread type and size, a pre-wound sideless bobbin will have more yards per bobbin than a bobbin with sidewalls. This is because a particular bobbin case can hold a bobbin with a maximum width or thickness and diameter. Without the need to have sidewalls that add to the width of the bobbin, a sideless bobbin can hold more yarn in a given bobbin case when compared to a pre-wound sidewall bobbin. This can have a positive impact on sewing productivity by reducing the number of times a bobbin must be changed as well as reducing the likelihood that the bobbin yarn will run out in the middle of a sewing pattern.

However, while sideless bobbins offer greater sewing productivity and less potential scrap, it is difficult to match the draw-off tension uniformity of a sidewall bobbin without creating excessive overspin. One must reduce the amount of tack to manufacture a sideless bobbin with a draw-off tension uniformity comparable to a sidewall bobbin. However, as the tack is reduced to improve the draw-off uniformity, the overspin of the sideless bobbin will increase. Conversely, if one increases the tack on the sideless bobbin to reduce any bobbin overspin then the draw-off tension becomes less uniform. This is because the yarn is tacked to an uneven underlying surface as each layer of yarn or thread is tacked to the previous layer. Thus, the more the tack level is increased to prevent or reduce overspin, the greater is the variation in bobbin draw-off uniformity.

Automatic bobbin changing equipment that loads the bobbin case with the full bobbin and unloads the bobbin case with the empty (or partially used) core has more recently attained widespread practice in the industry. Such automatic bobbin changing equipment that loads the bobbin case with the pre-wound bobbin installed in the bobbin case and unloads the bobbin case with the empty core or partially used bobbin requires that the bobbin remain securely in place in the bobbin case during the automatic loading and unloading operation. Pre-wound sidewall bobbins can be used in this automatic bobbin changing equipment as the mechanical finger on the bobbin case presses against the sidewalls during loading and unloading, thus securely holding the bobbin in the bobbin case during transfer by the automated bobbin changing equipment. However, conventional pre-wound sideless bobbins cannot be employed in automatic bobbin changing equipment since they do not have a sidewall.

The ability of longer yardage pre-wound sideless bobbins to stay securely in the bobbin case during automatic bobbin changing would have a positive impact on sewing productivity by reducing the number of bobbin changes and increasing the potential length of a continuous sewn pattern. In light of the above there is a need for a pre-wound high yardage sideless (with no sidewalls) bobbin that can be used in combination with automated bobbin changing equipment, and/or provides a more uniform draw-off tension throughout the bobbin while at the same time reducing the amount of overspin when sewing stops. It is toward fulfilling such a need that the present invention is directed.

SUMMARY OF THE INVENTION

Broadly, the present invention is embodied in pre-wound sideless bobbins having a cylindrical core with at least one end thereof being permanently magnetized. The core is most preferably in the form of a molded thermoplastic cylinder in which magnetized particles are dispersed in a predetermined amount to achieve desired draw-off tension uniformity and/or overspin characteristics, in addition to allowing the bobbin to be retained in the bobbin support case when inverted (i.e., to prevent the bobbin from falling by gravity from the case when inverted). In such a manner, the bobbins of this invention will promote improved productivity (i.e., since sideless bobbins can now be employed in end-use applications typically reserved for sidewall bobbins) while also promoting improved stitch uniformity (i.e., due to the improved draw-off tension uniformity) with less chance for thread breakage during sewing (i.e., due to significantly improved overspin characteristics).

These, and other aspects and advantages of the present invention will become more clear after careful consideration is given to the following detailed description of exemplary embodiments.

BRIEF DESCRIPTION OF THE ACCOMPANYING DRAWINGS

Figure 2:
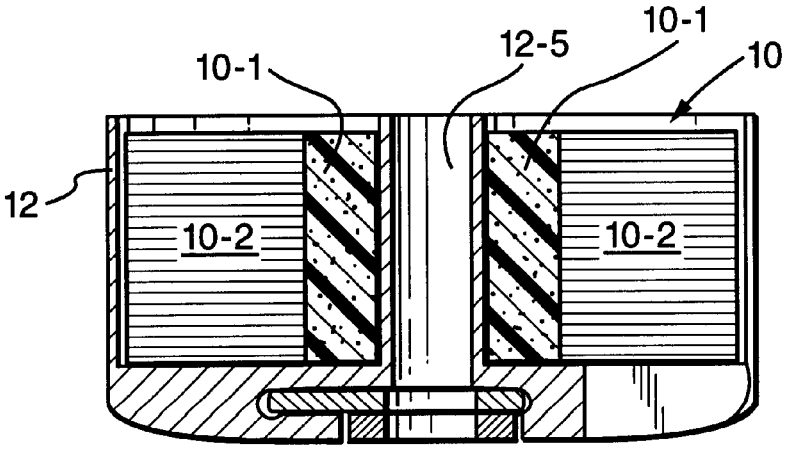

Reference will hereinafter be made to the accompanying drawings wherein like reference numerals throughout the various FIGURES denote like structural elements, and wherein, FIG. 1 is a perspective view of a magnetized pre-wound sideless bobbin in accordance with the present invention shown positioned within an exemplary bobbin case, and wherein the bobbin case is depicted as a light-line phantom for ease of viewing the bobbin contained therewithin; and FIG. 2 is a cross-sectional elevational view of the magnetized pre-wound bobbin shown in FIG. 1 as taken along line 2—2 therein.

DETAILED DESCRIPTION OF THE INVENTION

As used herein and in the accompanying claims, the term "overspin" and like terms are meant to refer to the amount of thread, in millimeters, which unwind from the bobbin in response to immediate draw-off stoppage of the thread following thread unwinding at a constant draw-off rate of 55 yards/minute.

The term "draw-off tension" is the tension force, in grams, of the thread during unwinding (draw-off) from the bobbin core.

"Nominal draw-off tension" is the average draw-off tension of the thread over a unit time period.

"Draw-off tension uniformity" is the percent deviation (±) of the tension from the nominal draw-off tension.

Accompanying FIGS. 1 and 2 show a pre-wound sideless bobbin 10 in accordance with the present invention positioned within a metal bobbin support housing 12 (known in the trade as the bobbin case). As can be seen, the bobbin 10 of this invention includes a magnetized core 10-1 around which a continuous length of thread 10-2 is wound. The thread end 10-3 may be passed through a slot 12-1 so it exits the bobbin case 12 at aperture 12-2. A leaf spring 12-3 presses against the thread end 10-3 so as to impart a desired amount of draw-off tension thereto, which may be selectively adjusted by set screws 12-4. When employing the bobbins 10 in accordance with the present invention, however, the leaf spring 12-3 associated with conventional bobbin cases 12 is not necessarily needed. Those in the art may nonetheless find it useful to employ the spring 12-3 in a conventional manner as an aid to obtain desired draw-off tensions and/or draw-off tension uniformities. The thread end 10-3 is operatively directed to the sewing needles (not shown) in a well known manner by means of conventional devices associated with the sewing machine.

The core 10-1 of the bobbin is coaxially sleeved over the support post 12-5 of the bobbin case 12 so that, during sewing, the bobbin 10 rotates to allow the thread 10-2 wound thereon to unwind.

The core is most preferably formed of any suitable thermoplastic resin (the carrier matrix), such as nylon, polyacetal, polyester, polyolefin or the like. Most preferably, the core is formed of a nylon, such as nylon-6, nylon-6,6, nylon-12 or the like. Thermoset resins may also be used as the carrier matrix. The thermoplastic material may conveniently be processed, e.g., by pressure bonding or injection molding, using conventional thermoplastic extruders, molds, dies and the like to form cylinders of the desired size. The thermoplastic resin may itself include other ingredients and/or components which are typically included with conventional thermoplastic resins such as, for example, stabilizers, antioxidants, lubricants, reinforcing agents, mold-release agents, coloring agents, inorganic and/or organic fillers and the like. Such additional ingredients and/or components may be used in any quantities provided that the magnetic properties of the core 10-1 are not significantly adversely affected. Other methods that may be employed to manufacture the magnetic core include sintering (typically used to shape rare earth magnetic powders without a carrier matrix), and casting (typically used with Alnico magnetic material).

The direction of the magnetic field (e.g., flux direction) may be radial relative to the cylindrical geometry of the core 10-1 or the direction of the magnetic field may be axial in which case the magnetic fields are directed generally parallel to the elongate axis of the core 10-1. Also, the core 10-1 may be multipolar if desired.

The thermoplastic resin forming the core 10-1 will necessarily include a dispersion of magnetized particles. Most preferably, the magnetized particles include ferromagnetic particles such as elemental iron particles, and/or ferrite (ceramic) powder based on barium or strontium carbonate (general composition $BaFe_2O_3$ or $SrFe_2O_3$). Alternatively or in addition to the ferrite particles, the particles can be formed of other magnetic materials such as rare earth magnetic materials (e.g., neodymium iron boron ($Nd_2Fe_{14}B$) or samarium cobalt ($SmCo_5$, $Sm_2Co_{,7}$)), or aluminum-nickel-cobalt (Alnico) alloys.

The material from which the core 10-1 is formed may be either anisotropic (i.e., magnetic material having a preferred direction of magnetic orientation, so that the magnetic characteristics are optimum in one preferred direction) or isotropic (i.e., magnetic material whose magnetic properties are the same in any direction, and which can therefore be magnetized in any direction without loss of magnetic characteristics). Typically, isotropic grades are magnetized after molding while the stronger anisotropic grades are oriented and magnetized during molding. The core of 10-1 of the present invention may be made from either isotropic or anisotropic materials.

One form of an isotropic material from which the core 10-1 may be made includes IMF/N2100 Pi available from Magnet Applications of Horsham, Pa. This material exhibits a residual induction (Br) of about 2100, and is manufactured (injection molded) from a nylon thermoplastic resin with a dispersion of isotropic ferrite and rare earth neodymium iron boron particles (see Bobbin 4 in Examples).

One form of an isotropic material from which the core 10-1 may be made includes IM-160 material from Kane Magnetics International of Kane, Pa. This material will exhibit a residual induction (Br) of about 2550, a coercive force (Hc) of about 2300 oersteds, an intrinsic coercive force (Hci) of 3100 oersteds and a maximum energy product ($Bh_{max}$) of about 1.4 (see Bobbin 3 in Examples). Another anisotropic material that may satisfactorily be used to form the core 10-1 of this invention is PLASTIFORM B-1060 magnetic material commercially available from The Arnold Engineering Company of Norfolk, Nebr. This material exhibits a residual induction (Br) of about 2650, a coercive force (Hc) of about 2425 oersteds, an intrinsic coercive force (Hci) of 4000 oersteds and a maximum energy product ($Bh_{max}$) of about 1.7.

The unit properties of the anisotropic and isotropic materials noted above were measured according to the Permanent Magnet Guidelines, MMPA-PMG-88 (1988) published by the Magnetics Materials Producers Association, the entire content of which is expressly incorporated hereinto by reference.

The finished dimensions of the core 10-1 may vary depending on the specific bobbin case size and/or the magnetic force required for a particular sewing application. However, it is presently preferred that the core 10-1 meet the size requirements for automatic bobbin changing equipment currently being used in the home furnishing market to sew, e.g., comforters. Thus, it is presently preferred that the core 10-1 have a length of between about 0.250 inch to about 0.450 inch, an inside diameter of between about 0.215 inch to about 0.299 inch, and more preferably between about 0.215 inch to about 0.245 inch and a wall thickness of up to about 0.099 inch, and more preferably up to about 0.050 inch. Each of these dimensions may, of course vary somewhat within the tolerance limits of the bobbin case dimensions and/or automatic bobbin changing equipment.

Virtually any type of continuous length thread 10-2 may be wound onto the core 10-1 to form the sideless bobbins 10 of the present invention. Thus, virtually any natural or synthetic thread may be employed. In addition, the thread may be yarns spun from staple fibers of desired length or continuous multifilament threads. Since the most preferred end-use application of the bobbins 10 in accordance with the present invention is the home furnishings and embroidery markets, it is preferred that conventional sewing thread deniers be employed. Most preferably, the thread is a thermoplastic synthetic sewing thread formed of continuous multifilaments (e.g., 34–68 ends) and having a finished thread denier of between about 60 to about 420.

The amount of magnetic force exhibited by the core 10-1 is sufficient to cause the core 10-1 to be magnetically attracted to the base of the bobbin case 12 and bobbin case post 12-5, so as to minimize overspin of the bobbin 10 in response to sewing stoppages while maintaining a desired draw-off tension of the thread being unwound.

According to the present invention, the magnetic force of the core 10-1 is sufficient to impart an overspin of less than about 15 mm, more preferably less than about 10 mm, and most preferably about 5 mm or less. Furthermore, the magnetic strength of the core 10-1 and the amount of tack on the thread wound on the core 10-1 is sufficient to provide a nominal draw-off tension of between about 15–40 grams, more preferably between about 20–35 grams and draw-off tension uniformity of less than about 10%, and more preferably about 8% or less.

The magnetic strength of the core must also be sufficient to allow the bobbins 10 of this invention to be used in combination with automatic bobbin changing equipment as has been mentioned previously. Thus, the magnetic strength of the core 10-1 must be sufficient to magnetically retain the core 10-1 in the bobbin case 12 when held in an inverted position. In other words, the magnetic strength of the core 10-1 must at least be sufficient so that the core 10-1 does not become disengaged from the bobbin case 12 when exposed to the gravitational or centrifugal forces of automatic bobbin changing equipment. In such a manner, the core 10-1 will be retained within the bobbin case 12 during automated bobbin change-outs using conventional automatic bobbin changing equipment.

In use, the bobbin case 12 will be received within a bobbin basket associated with the sewing machine (not shown). When the bobbin case 12 is removed from the basket after sewing (either manually or with the automatic bobbin changing equipment), the used bobbin 10 should extract with the bobbin case 12 rather than remaining in the bobbin basket. Thus, it is important to have a higher magnetic attraction between the magnetic core 10-1 and bobbin case 12 than between the core 10-1 and the bobbin basket (not shown) so that the core 10-1 and bobbin case 12 may be extracted as a unit.

One way to accomplish concurrent extraction of both the core 10-1 and the bobbin case 12 is to create an air gap between the base of the basket and the end of the magnetic core 10-1, if the magnetic core 10 has a uniform magnetic pattern (i.e., both ends of the wound bobbin core have substantially the same magnetic properties). This air gap can be created by placing a non-ferrous material (or coating) in the bobbin basket so that the magnetic attraction between the core 10-1 and bobbin case 12 is stronger than the magnetic attraction between the core 10-1 and bobbin basket. Examples of this technique include thin non-ferrous washers placed in the bottom of the basket or a coating on the basket comprised of PTFE or other non-ferrous materials. Using a bobbin basket where the base of the basket itself is made from a non-ferrous material would also ensure that the magnetic core 10-1 has a greater attraction to the bobbin case 12.

An alternative way to ensure that the core 10-1 has a greater attraction to the bobbin case rather than the basket is to manufacture the cylindrical core 10-1 with higher field strength on one end as compared to its other end. During molding (injection or compression), with the appropriate tool design, an Anisotropic cylindrical magnetic core 10-1 can be molded that exhibits a higher magnetic strength on one end of the cylinder than the other. Such differential magnetic properties of the core 10-1 can be accomplished using an electronic coil system or permanent magnets (P/M). The magnetic material would be "aligned" on the desired end of the cylindrical core 10-1, and not the other, thereby producing stronger magnetic properties and an imbalance of magnetic properties from one end of the core 10-1 to the other.

Alternatively, the core 10-1 can be molded (injection or compression) using isotropic techniques, in which case the core 10-1 can be magnetized after molding in a secondary operation, and again obtain similar "imbalanced" magnetic effects. This is done by "focusing" the magnetization pattern on one end of the core 10-1, skewing the flux lines so that they converge more on one end of the cylindrical core 10-1 than its other end. Assuming the bobbin 10 is installed correctly in the bobbin case 12, this would ensure that the used bobbin 10 extracts with the bobbin case 12 when removed.

Another variation to ensure that the core 10-1 has a greater attraction to the bobbin case rather than the basket is to co-inject a non-ferrous material into one end of the mold during injection molding. This would in effect create a magnetic core 10-1 where one end has reduced magnetic properties and thus, if installed correctly in the bobbin case 12, would extract with the bobbin case 12 when removed rather than be equally attracted to, and thus possibly remain in, the bobbin basket.

Another variation to ensure that the magnetic core 10-1 has a greater attraction to the bobbin case 12 when removed, rather than possibly remain in the bobbin basket, would be to assemble a two part core where one end or section of the core is made from a non-ferrous material and is then attached to a magnetic core. This would in effect create a magnetic core 10-1 where one end, or section of an end, has no (or reduced ) magnetic properties and thus if installed correctly in the bobbin case the core would extract with the bobbin case 12 when removed rather than be equally attracted to, and thus possibly remain in, the bobbin basket.

The present invention will be further understood after consideration is given to the following non-limiting Examples.

EXAMPLES

The following sideless bobbins (designated as Bobbins 1, 2, 3 and 4) were made using 100 denier nylon sewing thread (high tenacity 7.7–8.1 grams per denier) with 34 filaments per thread manufactured by Solutia Inc. of Charlotte, N.C.

The commercial, as-supplied, sewing thread was coated with a commercially available solution of nylon terpolymer in alcohol (methanol). More specifically, the nylon terpolymer employed as the coating material is a linear polyamide (CAS# 25191-90-6) which is solubilized in alcohol. The preferred nylon terpolymer coating material is the Type 637 and 651 nylon multipolymer resins commercially available from the Shakespeare® Monofilament Division of Anthony Industries Company. The nylon terpolymer in alcohol is coated onto the surface of the thread in an amount to achieve a dried residue of the nylon terpolymer of between about 3% to about 7% by weight of the thread.

When wound onto the core, the coated thread was brought into contact (i.e., via kiss roll) with a predetermined amount of methanol as a tacking agent to achieve the desired thread-to-thread tack and thereby provide the desired nominal draw-off tension. The coated and tacked thread was wound onto the core so as to achieve a nominal bobbin diameter (including the diameter of the core and the thread wound thereon) of between about 0.830" to about 0.860".

Each of the non-magnetic cores of Bobbins 1 & 2 were molded from polypropylene and having a nominal 0.320" axial length, an inside diameter of 0.248" and a wall thickness of 0.036". The cores employed in Bobbins 3 & 4 were formed of molded nylon which included a dispersion therein of magnetized particles. Specifically, the core of Bobbin 3 was formed from IM-160 anisotropic magnetic material available from Kane Magnetics International of Kane, Pa. with the unit properties described previously and having a nominal 0.350" axial length, an inside diameter of 0.235" and a wall thickness of 0.036". The core of Bobbin 4 was formed from IMF/N2100 Pi isotropic magnetic material available from Magnet Applications of Horsham, Pa. with the unit properties described previously and having a nominal 0.350" axial length, an inside diameter of 0.235" and a wall thickness of 0.043".

Bobbin 1 (Comparative)

Thread tacked to achieve a nominal 28 g draw-off tension (designated as "Tack Level A") using a conventional non-magnetized (abbreviated in the table below as "non-mag") polypropylene core.

Bobbin 2 (Comparative)

Same construction as Bobbin 1, but reduced amount of tack to achieve a nominal 20 g draw-off tension (designated as "Tack Level B") using a conventional non-magnetized (abbreviated in the table below as "non-mag") polypropylene core.

Bobbin 3 (Invention)

Thread tacked in the same reduced amount as in Bobbin 2 (Tack Level B) but wound around a magnetized (abbreviated in the table below as "mag") nylon core.

Bobbin 4 (Invention)

Thread tacked to achieve a similar nominal tension as in Bobbin 3 (Tack Level C) but wound around a magnetized (abbreviated in the table below as "mag") nylon core.

Each of the bobbins was examined for nominal tension, tension variance (from which draw-off tension uniformity could be derived) and overspin. The tension data was obtained by placing the bobbin horizontally over a support post so that the bobbin could freely rotate. The yarn wound on the bobbin was then threaded through a tension disk (McCoy Ellison) set at position E with each disc calibrated to 20 grams, through an electronic tensiometer having a chart recorder (Checkline Model TE100) and then to a driven take-up spool, in that order. The take-up spool was then driven to achieve a nominal 55 yds/min. thread unwinding rate, following which the chart recorder was started so as to obtain the take-off tension data. In this regard, the nominal tension (grams) was the average tension noted on the chart recorder, while the tension variance was represented by the absolute values, in grams, of the minimum and maximum recorded tensions.

The overspin data for each bobbin was obtained by placing the bobbin in a bobbin case and directing the thread under the leaf spring associated therewith. The thread was then directly connected to a driven take-up spool capable of unwinding the thread from the bobbin at a constant rate. The thread was then cut while being unwound at a constant unwinding rate of 55 yds/min. The bobbin was then positionally fixed and the loose thread end pulled at its point of exit from the bobbin case to remove all slack until the bobbin begins to rotate. The amount of thread, in millimeters, which is thus pulled from the bobbin case following its being cut is the amount of overspin.

| | (1) | (2) | (3) | (4) |
|---|---|---|---|---|
| Nominal Tension:: | 28 g | 20 g | 27 g | 26 g |
| Tension Variance: | 8 g | 4 g | 4 g | 4 g |
| Draw-Off Tension Uniformity: | 14% | 10% | 7% | 8% |
| Overspin Amount | 16 mm | 24 mm | 5 mm | 3 mm |
| Core Type: | Non-Mag | Non-Mag | Mag | Mag |
| Tack Level: | A | B | B | C |

Comparing the data for Bobbins 1 and 2, it can be seen that reducing the tack from 28 g to 20 g achieved a significant reduction of tension variance of 50% (i.e., 8 g for Bobbin 1 vs. 4 g for Bobbin 2). However, the amount of bobbin overspin increased disadvantageously from 16 mm to 24 mm. Stated another way, while the tension variance was reduced by 50% in response to a reduction of tack levels, the amount of overspin correspondingly (and disadvantageously) increased by 50%.

The data for Bobbin 3 & 4 in accordance with this invention, however, demonstrate that, for the same relatively low tack level as was employed with Bobbin 2, the presence of the magnetic core raised the nominal draw-off tension to 27 g and 26 g respectively, but the uniformity of draw-off tension was advantageously reduced as compared to Bobbin 2. Significantly, also, the overspin for Bobbin 3 & 4 was reduced to only 5 mm and 3 mm respectively, reflecting the function of the magnetized core as a "breaking" means to reduce bobbin overspin.

In summary, therefore, the data demonstrates that by reducing tack and introducing a magnetic core, the present invention is able to maintain a similar nominal draw-off tension as compared to conventional sideless bobbins, but has the significant advantage of exhibiting improved draw-off tension uniformity and reduced bobbin overspin.

While the invention has been described in connection with what is presently considered to be the most practical and preferred embodiment, it is to be understood that the invention is not to be limited to the if disclosed embodiment, but on the contrary, is intended to cover various modifications and equivalent arrangements included within the spirit and scope of the appended claims.

What is claimed is:

1. A pre-wound flangeless, sideless bobbin comprising a core, and a continuous length thread wound about said core, wherein said core has at least one end which is permanently magnetized.

2. A bobbin as in claim 1, wherein said at least one end of said core is formed of a thermoplastic or thermoset resin in which magnetized particles are dispersed.

3. A bobbin as in claim 2, wherein said magnetized particles include ferrite particles, rare earth magnetic particles, aluminum-nickel-cobalt alloy particles or mixtures thereof.

4. A bobbin as in claim 1, wherein said core has a magnetic field strength sufficient to impart a nominal draw off tension of between about 15–40 grams, a draw-off tension uniformity of less than 10% and a thread overspin amount of less than about 15 mm.

5. A bobbin as in claim 1 or 4, wherein said core has a magnetic field strength sufficient to retain said bobbin core in a bobbin case when inverted.

6. A bobbin as in claim 1, 2, 3 or 4, wherein the entirety of said core is permanently magnetized.

7. A bobbin as in claim 1, 2, 3 or 4, wherein said one end of said core has a greater magnetic field strength as compared to an opposite end thereof.

8. A bobbin as in claim 7, wherein said opposite end of said core is formed of a non-magnetic material coaxially joined to said one end thereof.

9. A bobbin as in claim 7, wherein the entirety of said core is formed of a magnetic material, and wherein said one end is formed so as to exhibit said greater magnetic effect as compared to said opposite end thereof.

10. A pre-wound flangeless, sideless bobbin having a continuous length of tacked thread wound about a core having at least one end which is permanently magnetized.

11. A bobbin as in claim 1 or 10, wherein said thread is coated with an alcohol-soluble resin, and wherein said thread is tacked using an alcohol in which said resin is soluble.

12. The combination comprising a metal bobbin case having a central post, and a flangeless, sideless bobbin mounted in said case, said bobbin including:

(i) a cylindrical bobbin core having at least one end thereof which is permanently magnetized and which is sleeved over said central post of said bobbin case, and (ii) a continuous length of sewing thread wound about said core, wherein (ii) said bobbin is mounted in said case such that said at least one permanently magnetized end of said bobbin core is adjacent said bobbin case.

13. The combination as in claim 12, wherein said at least one end of said core has a magnetic field strength sufficient to impart a nominal draw off tension of between about 15–40 grams, a draw-off tension uniformity of less than 10% and a thread overspin amount of less than about 15 mm.

14. The combination as in claim 12 or 13, wherein said at least one end of said core has a magnetic field strength sufficient to retain said core sleeved over said central post of said bobbin case when inverted.

15. The combination as in claim 12, wherein said core has a magnetic field strength sufficient to impart a nominal draw-off tension of between about 20–35 grams.

16. The combination as in claim 12, wherein said core has a magnetic field strength sufficient to impart a draw-off tension uniformity of about 8% or less.

17. The combination as in claim 12, wherein said core has a magnetic field strength sufficient to impart an overspin amount of about 5 mm or less.

18. The combination as in claim 12, wherein said core is formed of a thermoplastic or thermoset resin in which magnetized particles are dispersed.

19. The combination as in claim 18, wherein said magnetized particles are selected from the group consisting of (a) ferrite particles, (b) rare earth particles, (c) aluminum-nickel-cobalt particles, and (d) mixtures thereof.

20. The combination as in claim 12, wherein the entirety of said core is permanently magnetized.

21. The combination as in claim 12, wherein said one end of said core has a greater magnetic field strength as compared to an opposite end thereof.

22. The combination as in claim 21, wherein said opposite end of said core is formed of a non-magnetic material coaxially joined to said one end thereof.

23. The combination as in claim 21, wherein the entirety of said core is formed of a magnetic material, and wherein said one end is formed so as to exhibit said greater magnetic effect as compared to said opposite end thereof.

24. The combination comprising a metal bobbin case having a central post, and a flangeless, sideless bobbin mounted in said case, said bobbin including a cylindrical bobbin core having at least one end thereof which is permanently magnetized and which is sleeved over said central post of said bobbin case, and a continuous length of tacked sewing thread wound about said core, wherein said bobbin is mounted in said case such that said at least one permanently magnetized end of said bobbin core is adjacent said bobbin case.

25. The combination as in claim 12 or 24, wherein said thread is coated with an alcohol-soluble resin, and wherein said thread is tacked using an alcohol in which said resin is soluble.

26. A prewound flangeless, sideless bobbin mountable within a bobbin case for spinning movement during thread unwinding, wherein said bobbin includes:

a cylindrical core; and thread wound about said core; wherein said core is permanently magnetized to exhibit a magnetic field of sufficient strength to be magnetically attracted to the bobbin case in which the bobbin is mounted so as to minimize overspin of the bobbin in response to stoppage of spinning movement thereof while maintaining a desired unwinding draw-off tension of the thread.

27. The bobbin as in claim 26, wherein said at least one end of said core has a magnetic field strength sufficient to impart a nominal draw off tension of between about 15–40 grams, a draw-off tension uniformity of less than 10% and a thread overspin amount of less than about 15 mm.

28. The bobbin as in claim 26 or 27, wherein said at least one end of said core has a magnetic field strength sufficient to retain said core sleeved over said central post of said bobbin case when inverted.

29. The bobbin as in claim 26, wherein said core has a magnetic field strength sufficient to impart a nominal draw-off tension of between about 20–35 grams.

30. The bobbin as in claim 26, wherein said core has a magnetic field strength sufficient to impart a draw-off tension uniformity of about 8% or less.

31. The bobbin as in claim 26, wherein said core has a magnetic field strength sufficient to impart an overspin amount of about 5 mm or less.

32. The bobbin as in claim 26, wherein said core is formed of a thermoplastic or thermoset resin in which magnetized particles are dispersed.

33. The bobbin as in claim 32, wherein said magnetized particles are selected from the group consisting of (a) ferrite particles, (b) rare earth metal particles, (c) aluminum-nickel-cobalt particles, and (d) mixtures thereof.

34. The bobbin as in claim 26, wherein the entirety of said core is permanently magnetized.

35. The bobbin as in claim 26, wherein said one end of said core has a greater magnetic field strength as compared to an opposite end thereof.

36. The bobbin as in claim 35, wherein said opposite end of said core is formed of a non-magnetic material coaxially joined to said one end thereof.

37. The bobbin as in claim 35, wherein the entirety of said core is formed of a magnetic material, and wherein said one end is formed so as to exhibit said greater magnetic effect as compared to said opposite end thereof.

38. The bobbin as in claim 26, wherein said thread is tacked.

39. The bobbin as in claim 26 or 38, wherein said thread is coated with an alcohol-soluble resin, and wherein said thread is tacked using an alcohol in which said resin is soluble.

* * * * *